United States Patent [19]

Hanyu et al.

[11] Patent Number: 4,522,134

[45] Date of Patent: Jun. 11, 1985

[54] PATTERN GENERATING SYSTEM OF COMPUTER SEWING MACHINE

[75] Inventors: Susumu Hanyu; Hideaki Takenoya, both of Tokyo; Shinichi Kato, Koganei, all of Japan

[73] Assignee: Janome Sewing Machine Co. Ltd., Tokyo, Japan

[21] Appl. No.: 558,851

[22] Filed: Dec. 7, 1983

[30] Foreign Application Priority Data

Dec. 15, 1982 [JP] Japan ..... 57-218430

[51] Int. Cl.[3] ..... D05B 3/02

[52] U.S. Cl. ..... 112/453

[58] Field of Search ..... 112/158 E, 275, 277, 112/121.11, 121.12, 102, 103

[56] References Cited

U.S. PATENT DOCUMENTS

| | | | |
|---|---|---|---|
| 4,135,462 | 1/1979 | Brown | 112/158 E |
| 4,372,232 | 2/1983 | Dunn et al. | 112/158 E |
| 4,399,760 | 8/1983 | Bergvall | 112/158 E |
| 4,479,448 | 10/1984 | Jones et al. | 112/158 E X |

*Primary Examiner*—Peter Nerbun

*Attorney, Agent, or Firm*—Michael J. Striker

[57] ABSTRACT

A pattern stitch sewing machine is disclosed in which enlarged patterns are made possible by storing a plurality of divided part patterns in an electronic memory. Further data for stopping the sewing needle at its lower dead point at the end of each part pattern is provided so that the operator may shift the fabric about the needle in preparation for sewing a succeeding part pattern.

1 Claim, 10 Drawing Figures

FIG_5

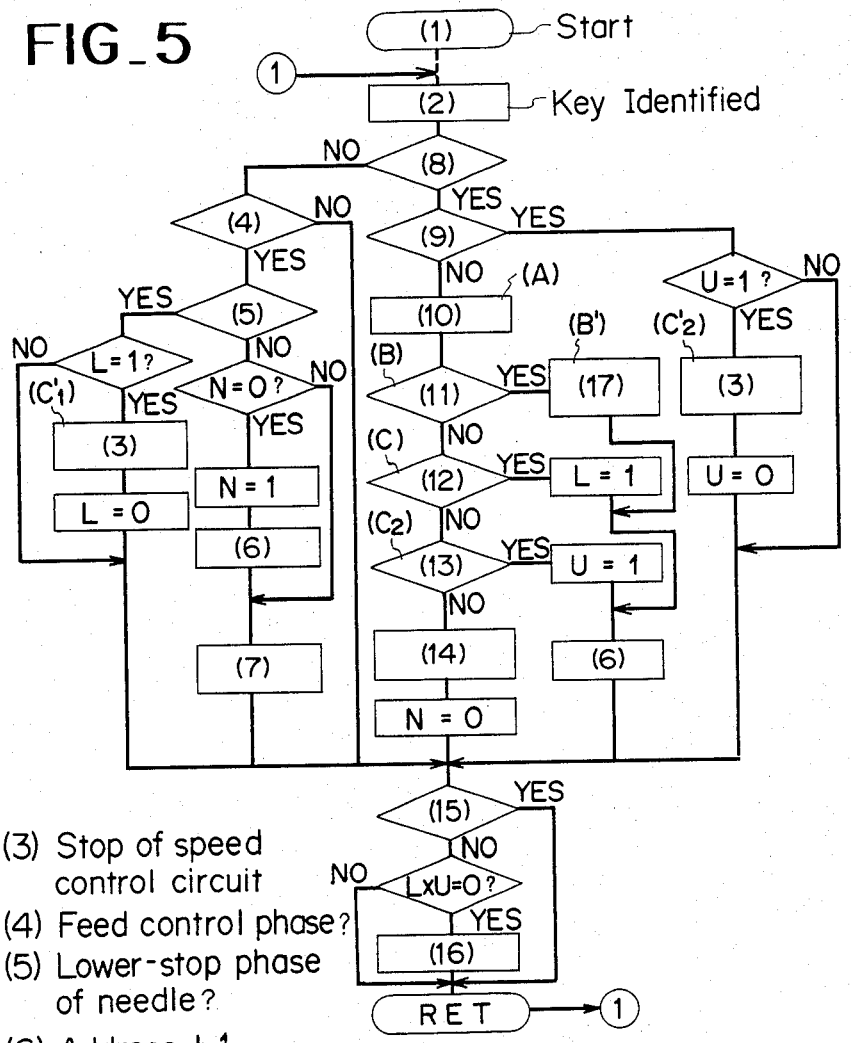

(3) Stop of speed control circuit
(4) Feed control phase?
(5) Lower-stop phase of needle?
(6) Address + 1
(7) Application of feed control data to feed control motor
(8) Needle position control phase ? (9) Upper-stop phase of needle ? (10) Pattern data reading-out
(11) Speed designating data ? (12) Lower-stop control data ? (13) Upper-stop control data ? (14) Application of needle position control data to needle position control motor (15) Controller ON ? (16) Speed control circuit accelerating (17) Speed control circuit slowing-down

| Address | Pattern data | |
|---|---|---|
| $n_0$ | Stitch control data | First part pattern |
| $n_0 + n'$ | Speed designating data | |
| $n_0 + n''$ | Lower-stop designating data | |
| $n_0 + n$ | Stitch control data | |
| $n_0 + m_0$ | Stitch control data | Second part pattern |
| $n_0 + m'$ | Speed designating data | |
| $n_0 + m''$ | Upper-stop designating data | |
| $n_0 + m$ | Stitch control data | |

PATTERN GENERATING SYSTEM OF COMPUTER SEWING MACHINE

BACKGROUND OF THE INVENTION

The invention relates to a computer sewing machine having a memory storing stitch control signals for producing various stitch patterns, and more particularly relates to a pattern generating system of such a computer sewing machine, which produces various parts of patterns in a predetermined sequence to provide an integrated bigger pattern with the help of auxiliary innovations being applied to the sewing machine.

According to the conventional computer sewing machine, an electronic memory stores stitch control signals which may, under programm control, produce various and complicated patterns with almost an unlimited number of stitches. However the lateral swinging movement of the needle is mechanically limited within a predetermined region of about 6–7 mm, and accordingly the stich patterns produced are subjected to this mechanical limitation in the direction of the needle swinging movement.

SUMMARY OF THE INVENTION

It is therefore an object of the present invention to produce a stitch pattern which is enlarged beyond the predetermined mechanical limitation in the direction of the needle swinging movement. For attaining this object, a pattern in question is stored in the memory in a plurality of divided part patterns in an equal number groups of stitch control signals (data), and in a predetermined sequence with respect to the pattern in question; Each of the part patterns has a machine motor speed designating data arranged near the end thereof for preparation of stopping the sewing machine. Each of the part patterns has another designating data arranged at the end thereof, except the last part pattern, to stop the sewing machine with the needle being held at the lower dead point thereof. The last part pattern has still another designating data arranged at the end thereof to stop the sewing machine with the needle being held at the upper dead point thereof, and then under the program control of a microcomputer, the sewing machine is stopped with the needle held at the predetermined position at the end of each part pattern indicate the machine operator that each of the part patterns has been finished, so that the machine operator may shift the fabric to be stitched in accordance with another part pattern.

BRIEF DESCRIPTION OF THE DRAWINGS

FIGS. 1–7 relate to the embodiment of the invention,

FIG. 1 is an electric control circuit shown in a block diagram of the present invention;

FIG. 2 is a perspective view of a presser foot of the present invention;

FIG. 3 is a pattern as prepared by the present invention composed of a series of part patterns;

FIG. 5 is a flow chart of control for the present invention;

FIG. 6 is a chart showing the relationship between the positions of the needle point and the angular positions of the upper drive shaft of the sewing machine;

FIG. 8 is a table showing the stitch control data and the addresses thereof stored in a memory.

DETAILED DESCRIPTION OF THE PREFERRED EMBODIMENT

Figure 1:
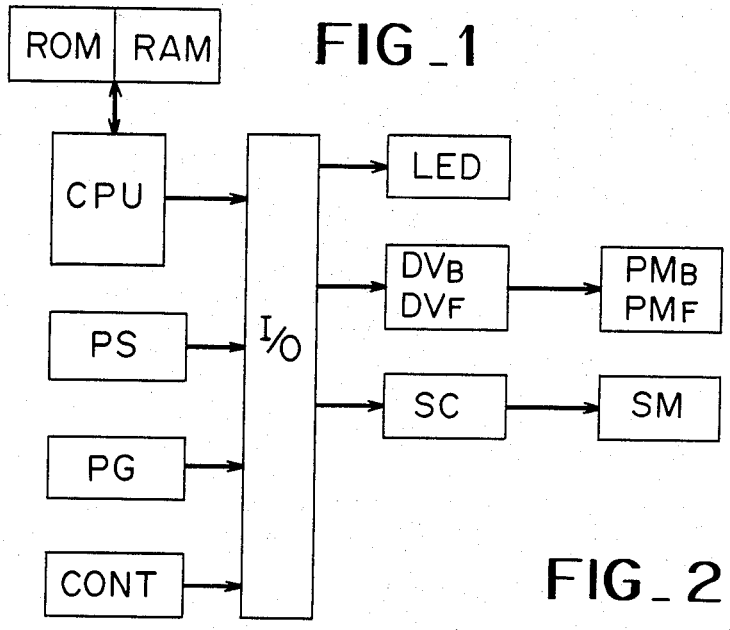

With reference to FIG. 1, a read only memory (ROM) stores stitch control signals as the needle position control data and the feed control data in each combination and each in a specific relation with the address thereof for a number of stitch patterns. As to a specifically bigger pattern, the memory stores the stitch control signals that are divided into a plurality of groups for as many part patterns that are sequentially read out to form the integrated bigger pattern. Each group of data preceding the last group of data includes speed designating data at a specific address near the end of the data group, and also includes stop designating data at an address at the end of the data group for stopping the sewing machine with the needle being held at the lower dead point thereof. Thus it is designated that the machine drive motor is slowed down by the speed designating data when each part pattern preceding the last part pattern has been stitched to near the end thereof, and then the machine drive motor is stopped by the stop designating data with the sewing machine needle being held at the lower dead point thereof when the part pattern has been completely stitched up.

On the other hand, the last group of stitch control signals for the last part pattern includes the speed designating data at an address near the end thereof, and also includes another stop designating data at an address at the end thereof. Thus, it is designated that the machine drive motor is slowed down by the speed designating data when the last part pattern has been stitched to near the end thereof, and then the machine drive motor is stopped by the stop designating data, with the sewing machine needle being held at the upper dead point thereof, when the last part pattern has been completely stitched up.

The memory (ROM) stores the stitch control data and the designating data which are to be read out and also stores program control signals for controlling the program of this pattern generating system.

A central processing unit (CPU) uses the program control signals of the memory (ROM) to control the program of the system, and a temporary data storing memory (RAM) temporarily stores the processes of the programming operations and the results thereof. The central processing unit (CPU), the memories (ROM, RAM) and an input and output device (I/O) constitute the microcomputer.

A pattern selecting device (PS) includes pattern selecting switches (not shown) which are provided on a sewing machine and selectively operated to give the pattern signal to the central processing unit (CPU).

A pulse generator (PG) is operated in synchronism with an upper drive shaft of the sewing machine to give pulse signals at two predetermined angular positions of the upper drive shaft, to thereby give the timings to the control processing unit (CPU) for stopping the needle of the sewing machine at the upper dead point and the lower dead point thereof, respectively. The pulse generator (PG) also gives the central processing unit a synchronizing signal per rotation of the upper drive shaft to read out the stitch control signals of the memory (ROM) per stitch.

A pattern selection indicating device (LED) includes a number of light emitting diodes (not shown) each provided in relation to each of the pattern indices. Upon receiving a pattern signal from the pattern selecting device (PS), the central processing unit (CPU) lights the corresponding light emitting diode to indicate that the pattern has been selected.

A sewing machine controller (CONT) is operated to variably designate the speed of the machine drive motor (SM). A speed control circuit (SC) is normally set to drive the machine drive motor at a high speed, and is adapted to control the speed of the motor from a low speed to a high speed in dependence upon the designation from the controller (CONT). Upon receiving the speed designating data read out from the memory (ROM), the speed control circuit (SC) drives the machine drive motor (SM) at a low speed irrespective of the operation degree of the controller (CONT). The speed control circuit (SC) also stops the machine drive motor (SM) with the needle of the sewing machine being held at the upper or the lower dead point thereof when the circuit (SC) receives stopping data from the central processing unit (CPU).

A pulse motor ($PM_B$) for controlling the needle position and another pulse motor ($PM_F$) for controlling the feed amount and direction are driven by drive circuits ($DV_B$, $DV_F$) respectively depending upon the needle position control data and the feed control data which are read out from the memory (ROM).

Figure 2:
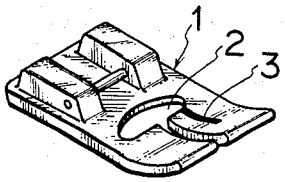

FIG. 2 shows a specific presser foot (1) of the present invention. The presser foot has a reference mark (3) provided on the extreme right end of a elongated needle dropping hole (2) defining a maximum region of the needle swinging movement. The reference mark (3) is positioned in the feeding direction at one (R) of the basic needle positions.

Figure 4A:
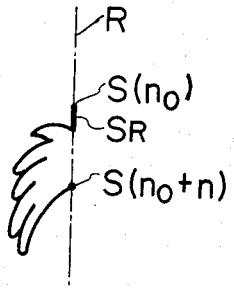
FIG. 4A is a first part pattern of FIG. 3.
Figure 4B:
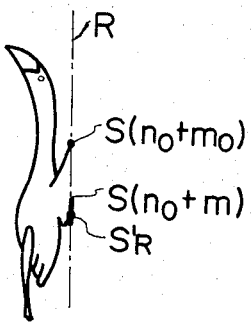
FIG. 4B is a second part pattern of FIG. 3.
Figure 3:
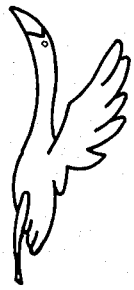

With the above mentioned combination of elements, the present invention is operated as follows for producing a stitch pattern such as shown in FIG. 3:

This stitch pattern has a lateral width extending beyond the maximum needle swinging movement. The memory (ROM) therefore stores a first part pattern as shown in FIG. 4A from the initial stitch S(no) to the last stitch S(no+n) and a second part pattern as shown in FIG. 4B from the initial stitch S(no+mo) to the last stitch S(no+m) as shown in the table in FIG. 8 where the stitch control data are each arranged in specific relation to the respective addresses together with the speed designating data and the stopping data.

The memory (ROM) also stores program control signals as already mentioned for carrying out the program control as shown by the flow chart in FIG. 5.

When a control power source is supplied, the central processing unit (CPU) takes a main role for starting the program control as shown in FIG. 5.

Figures 6, 8:
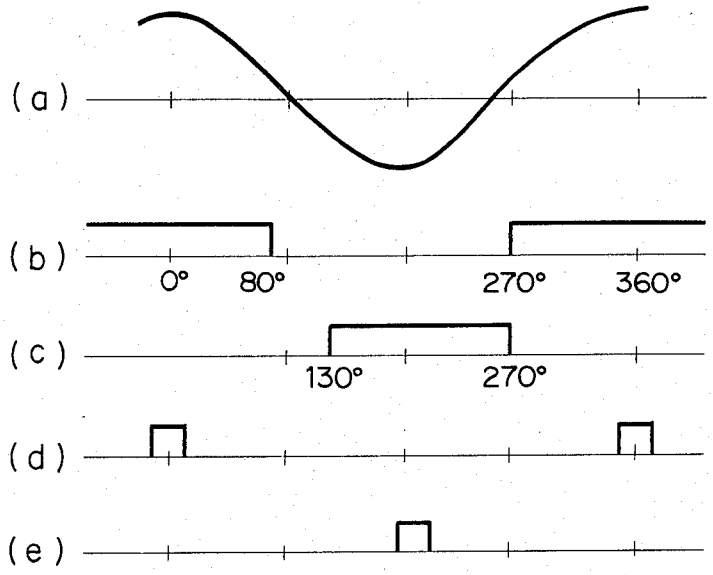

With the initial set as shown by a broken line, the flags U, L and N become 0, and a selected pattern is identified. The signal from the pulse generater (PG) is then discriminated. The pulse generator (PG) produces the high level signals respectively for the needle amplitude phase (b), the feeding phase (c), the upper-stop phase of needle (d) and the lower-stop phase of needle (e) as shown in FIG. 6, where the needle point (a) is at the upper dead point when the upper drive shaft of the sewing machine is at the angular position 0°. If the sewing machine is inoperative or is driven and if while the needle amplitude phase is presented instead of the upper-stop phase of needle, then the pattern data read out process (A) reads out the pattern data (stitch control data, speed designating data, upper-stop data or lower-stop data).

When the phase is the upper-stop phase of the needle, the flag upper-stop U is 0 which designates the needle not to stop at the upper dead point, and therefore the phase is waited to pass. Initially, the stitch control data at the address (no) is read out to the drive circuit ($DV_B$) for controlling the needle position control pulse motor ($PM_B$), to thereby control the needle position.

The address-advancing flag N is then made 0 again so as not to advance the addresses of the table. If the controller (CONT) is not operated, the speed control circuit (SC) is designated to a high speed and is operated to control the rotational speed of the machine drive motor (SM) from low speed to high speed depending upon the operation degree of the controller. The program is returned to ① and is then repeated.

If the controller (CONT) is operated and the sewing machine presents the feed control phase instead of the lowerstop phase, the flag N is changed to 1 from 0 to advance one address. Then the previously read out feed control data at the address (no) is applied to the drive circuit ($DV_F$) for controlling the feed control pulse motor ($PM_F$), to thereby control the fabric feed, and then the program is returned to ① .

When the lower-stop phase is reached, the program is returned to 1 because the lower-stop flag L is 0 which designates that the needle is not to stop at the lower dead point. As the flag N remains 1, the address will not be advanced, and the program is repeated. In this way the address is advanced one after another, and the stitch control data are sequentially read out to form the stitches.

The data to be read out next in the process (A) is the speed designating data at the address (no+n'). This data is discriminated in the low speed designating process (B) and designates the lower speed to the speed control circuit (SC) in the process (B'), to thereby advance the address in the table in FIG. 8, and the program is then returned to ① . In the same amplitude phase, the next pattern data is then read out. This is the stitch control data to control the needle position and the feed amount or direction during the low speed control of the sewing machine. After several stitches have been formed during the low speed control of the sewing machine, the data at the address (no+n'') for stopping the sewing machine with the needle being held at the lower dead point is discriminated in the process ($C_1$), and the flag L becomes 1. Thus the address in the table in FIG. 8 is advanced, and the program is returned then to ① .

The pattern data at the address (no+n) is then read out to drive the pulse motor ($PM_B$) for controlling the needle position, and the flag N becomes 0, and then the program is returned to ① . When the feed control is reached, the flag N becomes 1 to advance the address in the table in FIG. 8, to thereby drive the feed control pulse motor ($PM_F$), and the program is returned to ① . Subsequently, when the lower-stop phase is reached, the stop is designated to the speed control circuit (SC) in the process ($C'_1$), and the sewing machine is stopped with the needle being held at the lower dead point. The flange L then becomes 0, and the program is returned to ① . When the controller (CONT) is released, the speed control circuit (SC) is restored to the high speed designation because the flags L and U are both 0.

The first part pattern in FIG. 4A is formed from the stitch S(no) to the stitch S(no+n), and the sewing machine is stopped with the needle held at the lower dead point thereof. As shown, the first part pattern has the straight stitches ($S_R$) initially formed on the right basic needle position (R).

Figure 7A:
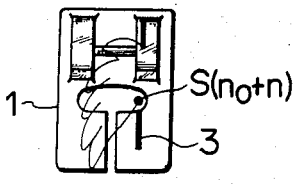
FIGS. 7A and 7B show the relationships between the fabric and a presser foot when the first part pattern has been finished.
Figure 7B:
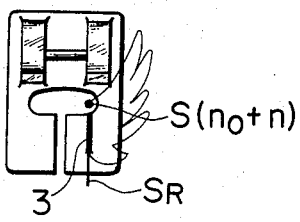

The sewing machine operator is then required to turn the fabric 180° around the needle which remains in the fabric at the last stitch S(no+n) from the condition of FIG. 7A to the condition of FIG. 7B. In this case, in order to precisely position the fabric, the straight stitches ($S_R$) are placed in alignment with the reference mark (3) provided on the presser foot (1) in the feeding direction.

If the controller (CONT) is operated again, the pattern data at the address (no+mo) and the following addresses are read out one after another, and the second part pattern is formed as shown in FIG. 4B in the same way as the first part pattern in FIG. 4A. The speed designating data at the address (no+m'o) is discriminated in the process (B) and gives the low speed designation to the speed control circuit (SC) in the process (B'). Subsequently several stitches are formed during the low speed control of the machine drive motor (SM). The data at the addresss (no+m'') for stopping the sewing machine with the needle being held at the upper dead point are then discriminated in the process ($C_2$), and the flag U becomes L to advance the address, and then the program is returned to ①.

Subsequently, the stitch control data at the address (no+m) is read out to drive the needle position control pulse motor ($PM_B$), and the flag N becomes 0, and then the program is returned to ①. When the feed control phase is reached, the flag N becomes 1 to advance the address, to thereby drive the feed control pulse motor ($PM_F$), and the program is then returned to ①. Subsequently, when the needle position control phase is reached, the stitch control data at the address (no) is read out to drive the needle position control pulse motor ($PM_B$), and to thereby control the needle positions for the initial stitches of the first part pattern in FIG. 4A, and the flag N becomes 0, then the program is returned to ①.

When the upper-stop control phase is reached, the stop designation is given to the speed control circuit (SC) in the process ($C'_2$), and the sewing machine is then stopped with the needle being held at the upper dead point, the flag U becomes 0, and the program is then returned to ①. Therefore the sewing machine is stopped before the finally read out stitch control data produces a stitch. When the sewing machine operator releases the controller (CONT), the speed control circuit (SC) is restored to a high speed designation.

Thus, the second part pattern as shown in FIG. 4B is formed from the initial stitch S(no+mo) to the final stitch S(no+m), and is together with the first part pattern as shown in FIG. 4A integrated into the complete pattern as shown in FIG. 3. When the sewing machine is stopped with the needle being held at the upper dead point thereof, the fabric may be freely shifted under the presser foot and/or the threads may be severed. In this case, the straight stitches ($S'_R$) may be formed at the end of the second part pattern on the right basic needle position in alignment with the straight stitches ($S_R$) of the first part pattern of FIG. 4A.

In this embodiment, the fabric has been turned 180° at the end of the first part pattern. It is of course possible to change the fabric turning angle in dependence upon the configuration of the complete pattern.

What is claimed is:

1. A pattern generating system of a computerized sewing machine, comprising:

a machine drive motor having a rotational speed;

a rotatable drive shaft having predetermined angular positions and rotated by said machine drive motor;

a needle for forming stitches and having positions including an upper dead point and a lower dead point;

a signal generator cooperating with said drive shaft to produce phase signals at said predetermined angular positions of said drive shaft to stop the sewing machine with said needle being held at either said upper dead point or said lower dead point;

a speed control circuit for controlling said rotational speed of said machine drive motor; and a microcomputer including program control means for controlling said speed control circuit, a memory for storing a plurality of groups of stitch control data each having an end and including a last group of stitch control data and feed control data, said groups of stitch control data being sequentially readout in a predetermined order in synchronism with the rotation of said drive shaft under control of said program means to thereby control said positions of said needle and feed positions for a predetermined number of patterns, said memory also having a first stop designating data group included at the end of each of said plurality of groups of stitch control data, except said last group of stitch control data, for stopping the sewing machine with said needle being held at said lower dead point, and a second stop designating data group included at the end of said last group of stitch control data, said program control means operating in synchronism with the rotation of said drive shaft to sequentially read out said plurality of groups of stitch control data and said first and second stop designating data groups, said speed control circuit receiving said first or second stop designating data group to stop the sewing machine with the needle being held at said upper or lower dead points respectively when one of said phase signals has been produced from said signal generator.

* * * * *